United States Patent [19]

Wachendorfer, Sr.

[11] 4,156,625

[45] May 29, 1979

[54] METHOD OF MAKING A MONOLITHIC REFRACTORY RECUPERATOR

[76] Inventor: Paul L. Wachendorfer, Sr., 1 Hollacher Dr., Northport, Long Island, N.Y. 11768

[21] Appl. No.: 718,334

[22] Filed: Aug. 27, 1976

[51] Int. Cl.[2] ..... F28F 13/08

[52] U.S. Cl. ..... 156/245; 165/147; 165/164; 165/165

[58] Field of Search ..... 156/87, 89, 245; 264/56; 165/147, 158, 159, 161, 164, 165, 166, 167, 173, 174, 175

[56] References Cited

U.S. PATENT DOCUMENTS

| | | | |
|---|---|---|---|
| Re. 19,701 | 9/1935 | Wilson | 165/165 |
| 659,602 | 10/1900 | Bredel | 165/165 |
| 1,571,068 | 1/1926 | Stancliffe | 165/165 |
| 1,670,127 | 5/1928 | Stancliffe | 165/165 |
| 2,018,163 | 10/1935 | Wells | 165/147 |
| 2,092,402 | 9/1937 | Morton et al. | 165/164 |
| 2,764,398 | 9/1956 | Herman | 165/147 |
| 2,821,369 | 1/1958 | Hilliard | 165/164 |
| 3,272,260 | 9/1966 | Raub et al. | 165/165 |
| 3,315,739 | 4/1967 | Kearney | 165/165 |
| 3,339,631 | 9/1967 | McGurty et al. | 165/147 |

FOREIGN PATENT DOCUMENTS

| | | | |
|---|---|---|---|
| 279868 | 8/1913 | Fed. Rep. of Germany | 165/147 |

*Primary Examiner*—Caleb Weston
*Attorney, Agent, or Firm*—Pennie & Edmonds

[57] ABSTRACT

A heat recuperator comprises a monolithic refractory block containing a first array of waste gas passages and a second array of combustion air passage segments oriented perpendicular to the waste gas passages. At least one turnaround manifold interconnects successive combustion air passage segments into multiple-pass passages. Preferably waste gas passages are tapered from a larger area entry aperture to a smaller area exit aperture. Successive combustion air segments are preferably tapered in opposite directions in the refractory block so that they can be interconnected to form a multiple pass passage with a substantially continuous taper from a smaller area initial entry aperture to a larger area exit aperture. The monolithic refractory block containing integral passages can be formed in a single casting or ramming operation.

9 Claims, 5 Drawing Figures

METHOD OF MAKING A MONOLITHIC REFRACTORY RECUPERATOR

BACKGROUND OF THE INVENTION

This invention relates to a heat recuperator which is particularly useful in modern convection heating furnaces and, in particular, to a heat recuperator the major portion of which can be cast or rammed as a monolithic block of refractory material.

The rising cost of fossil fuels combined with the increased regulation of fossil fuel furnaces with respect to environmental conformity makes efficient use of such furnace systems imperative.

While heat exchangers for increasing the efficiency of fossil fuel furnaces have long been known, the known refractory structures are not suitable for economical fabrication or for use with modern convective combustion systems.

Typically, recuperators have heretofore been made by building up a plurality of interlocking ceramic pieces, each having tubular passages therein, in a manner defining mutually tranverse waste gas and combustion air passages. Typically the passages have a substantially uniform cross-section throughout their extent. Such built-up recuperators, however, are expensive to construct, thermally unhomogeneous, and unreliable because of leakage through numerous joints between adjacent pieces. The problem of leakage is particularly significant since modern convection heating furnaces have high combustion air entry pressures and discharge waste gases at substantially higher draft pressures than older furnaces.

As a consequence of the unreliability of built-up recuperators, industry has turned primarily to all-welded alloy steel recuperators. These recuperators, however, are very expensive because of the high cost of alloy materials and because skilled technicians are needed to perform the many separate welding operations required.

SUMMARY OF THE INVENTION

A heat recuperator comprises a monolithic refractory block containing a first array of waste gas passages and a second array of combustion air passage segments oriented perpendicular to the waste gas passages. At least one turnaround manifold interconnects successive combustion air passage segments into multiple-pass passages. Preferably, waste gas passages are tapered from a larger area entry aperture to a smaller area exit aperture. Successive combustion air segments are preferably tapered in opposite directions in the refractory block so that they can be interconnected to form a multiple pass passage with a substantially continuous taper from a smaller area initial entry aperture to a larger area exit. The monolithic refractory block containing integral passages can be instantly formed in a single casting or ramming operation.

BRIEF DESCRIPTION OF THE DRAWINGS

The advantages, nature and various additional features of the present invention will appear more fully upon consideration of the illustrative embodiments now to be described in detail in connection with the accompanying drawings.

In the drawings.

For convenience of reference, corresponding structural features are given the same reference numerals throughout the drawings.

DETAILED DESCRIPTION

Figure 1:
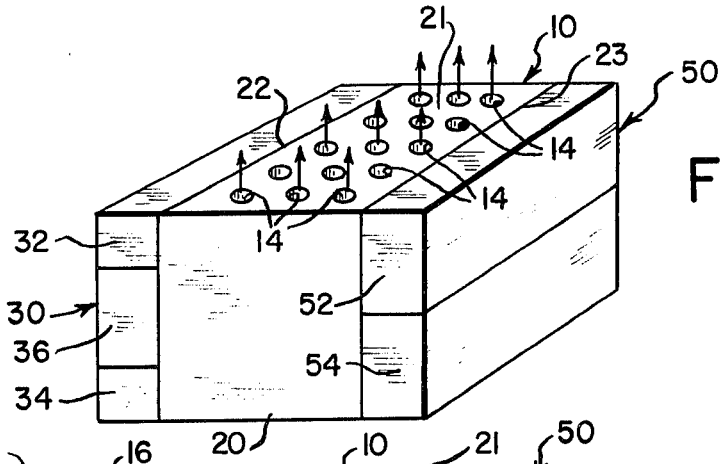
FIG. 1 depicts a perspective view of a heat recuperator in accordance with a first illustrative embodiment of the invention.
Figure 3:
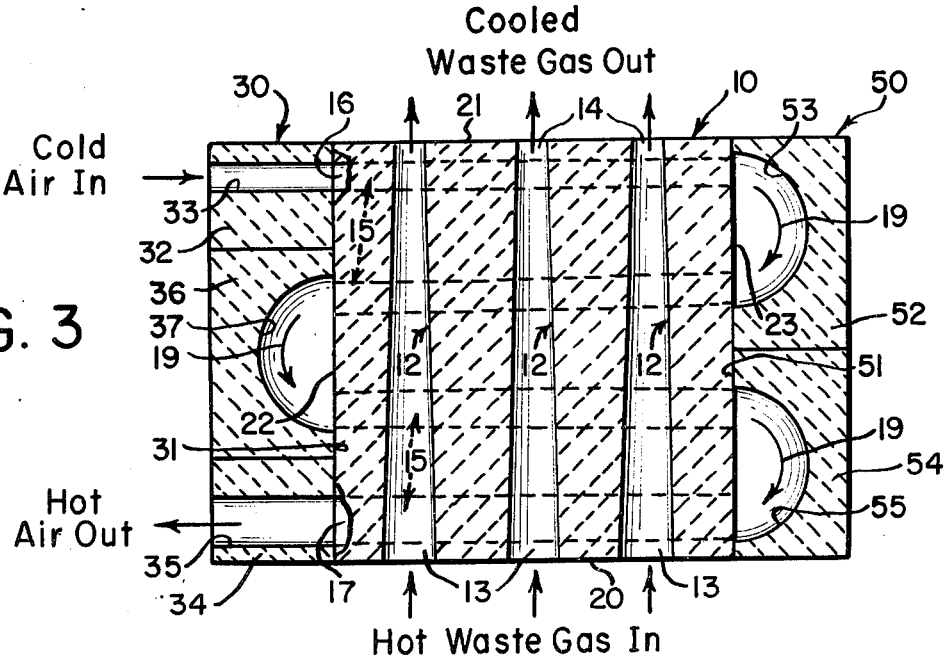
FIG. 3 is a cross-section along line 3—3 of FIG. 2.

Referring to the drawings, FIG. 1 is a perspective view of a heat recuperator in accordance with the invention comprising a monolithic heat exchange block 10 and a pair of turnaround manifold blocks 30, 50 mechanically coupled thereto. The monolithic heat exchange block 10 contains two two-dimensional arrays of substantially perpendicular tapered passages therethrough. As shown in FIGS. 1 and 3, the first array of tapered passages is a series of straight-line, vertical once-through waste gas passages 12 which are laid out in a two-dimensional array traversing block 10 between opposing surfaces 20 and 21. The cross-sectional area of the waste gas entry apertures 13 is larger than the area of the exit apertures 14, and the area of intermediate cross sections are linearly proportionate. Preferably the tapered waste gas passages are conical passages with parallel straight-line axes.

Figure 4:
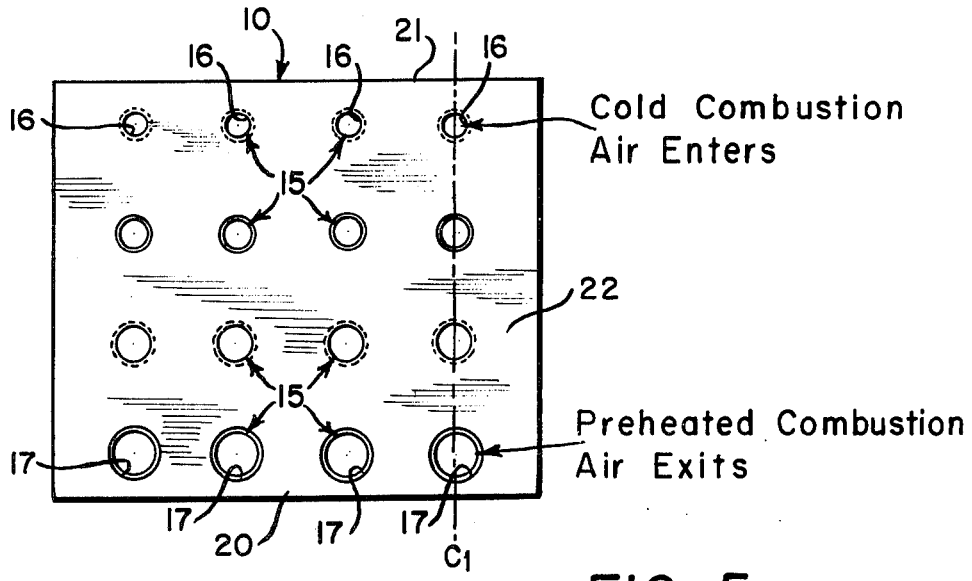
FIG. 4 is a side view of a monolithic heat exchange block used for the recuperator of FIG. 1.

The second array of tapered passages is a series of horizontal combustion air passage segments 15 which are laid out in a two-dimensional array traversing block 10 between a second pair of opposing surfaces 22 and 23 perpendicular to waste gas entry and exit surfaces 20 and 21. As shown in the side view of FIG. 4, on each of surfaces 22 and 23 the air passage apertures form a two-dimensional array. Adjacent horizontal segments 15 in the same vertical column of the array are tapered in opposite directions in block 10. As one moves along a given column, e.g. $C_1$, in the array on surface 22 from the initial entry aperture 16, the apertures increase in diameter in a progression of the form $A_o$, $A_o+2A$, $A_o+2A$, $A_o+4A$, . . . . On opposing surface 23, the progression is of the form $A_o+A$, $A_o+A$, $A_o+3$ A, $A_o+3$ A, . . . . As a result, when the ends of adjacent segments are interconnected by turnaround manifolds 30, 50 as will be detailed below, a multiple pass air passage is formed with a substantially continuous overall taper from a smaller area initial block entry aperture 16 to a larger area final block exit aperture 17. Preferably the tapered combustion air passage segments are conical passages with slight angular displacements of the axes of adjacent segments in the vertical direction shown in FIG. 4 in order to preclude parallel adjacent segments. Such displacement of not less than about 3° minimizes thermal stress.

The advantages of tapered passages, which are not readily obtained by prior art recuperator construction techniques, are manifold. The tapering serves to maintain a constant velocity of gas through the respective passages despite expansion or contraction due to heating or cooling of the moving gases. This effect enhances the thermal efficiency of the recuperator. In addition, the tapering serves to maintain a substantially constant density of ceramic material throughout the monolithic block. Such constant density increases the effective specific heat of the block. Moreover, the tapering aids in eliminating parallel shear lines along which the block might fail.

Block 10 is preferably a rectangular parallelopiped of cast or rammed refractory material such as an aluminosilicate ceramic. The desirable physical properties for such a material under normal operating conditions set forth in Table 1 below. These values can vary within plus or minus 5 percent and remain within the preferred range.

TABLE 1

| °C. | MODULUS OF RUPTURE Kg/cm$^2$ | COMPRESSIVE Strength Kg/cm$^2$ | THERMAL Conductivity Kcal/m . hr . ° C. |
|---|---|---|---|
| 800 | 48.00 | 76.00 | 2.00 |
| 1000 | 42.00 | 77.00 | 2.02 |
| 1200 | 115.00 | 57.00 | 2.03 |
| 1400 | 140.00 | 7.00 | 2.03 |

Preferred dimensions for a heat exchange block 10 suitable for a furnace having a 6 million BTU fuel flow are listed in Table 2, below:

TABLE 2

| | |
|---|---|
| Length: | 2 meters |
| Width: | 2 meters |
| Height: | 2.5–3 meters |
| Waste Gas Entry: | 126mm diameter |
| Waste Gas Exit: | 90mm diameter |
| Combustion Air Entry: | 90mm diameter |
| Combustion Air Exit: | 126mm diameter |
| Number of Waste Gas Passages: | 36 in a 6 × 6 array |
| Number of Combustion Air Passage Segments: | 40 in a 5 × 8 array |

Figure 2:
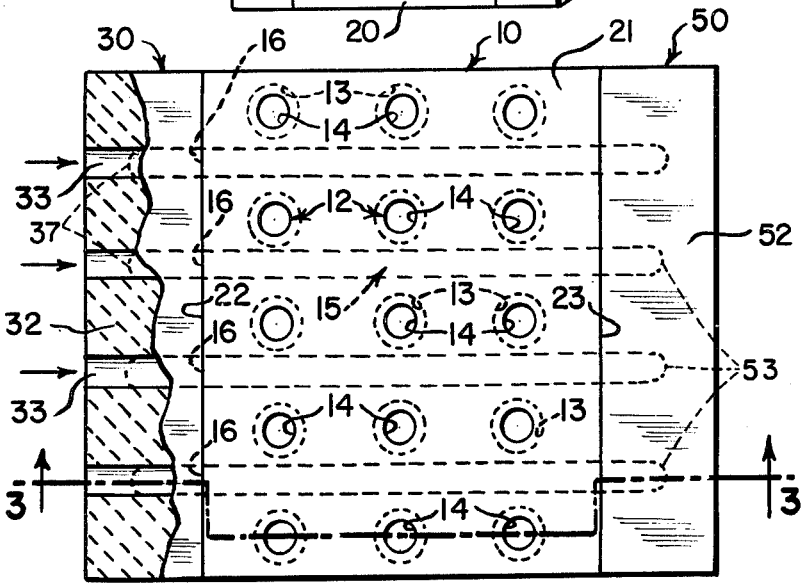
FIG. 2 is a top view with partial cross-section of the recuperator of FIG. 1.

FIGS. 2 and 3 illustrate the details of turnaround manifold blocks 30 and 50. These manifolds provide passages, conveniently in the form of dished depressions in a surface of the manifold or channels therethrough, keyed to interconnect successive combustion air passage segments in each column shown in FIG. 4 so that the combustion air traverses back and forth through block 10 as indicated by arrows 19 of FIG. 3. They also provide entry and exit ports for the combustion air.

Left turnaround manifold 30 comprises a block 32 of refractory material having air entry passage 33, a block 34 of refractory material having air exit passages 35 and a block 36 of refractory material having passages 37 for interconnecting the apertures of adjacent combustion air passage segments 15 on the left surface 22 of the monolithic block 10.

Right turnaround manifold 50 is structured to interconnect the apertures of adjacent combustion air passage segments 15 on the right surface 23 of the monolithic block. Manifold 50 comprises a block 52 of refractory material having passages 53 and a block 54 of refractory material having passages 55 for interconnecting the apertures of adjacent combustion air passage segments 15.

Advantageously, blocks 36, 52 and 54 are identical and passages 37, 53 and 55 have a cross-section at least as large as any aperture to which the block is connected. Preferably, passages 37, 53 55 are suitably shaped depressions in the surfaces of blocks 36, 52, 54 as shown in FIG. 3 but they could also be channels tunneling through the block. Alternatively, manifolds 30 and 50 can be formed as monolithic structures.

As can be seen in FIG. 3, in the attachment of the heat exchange block 10 and the turnaround manifolds 30 and 50, surface 31 of left turnaround block 30 is positioned in engagement with left surface 22 of block 10 so that passages 37 interconnect adjacent passage segments 15 of each column. Similarly, surface 51 of right turnaround block 50 is positioned in engagement with right surface 23 of block 10 in order to interconnect adjacent segments, thereby completing the linkage of the intermediate segments of each column into a multiple-pass combustion air passage with a substantially continuous over-all taper from a smaller area initial entry aperture to a larger area final exit aperture. Conveniently, monolithic block 10 and the blocks in the two turnaround manifolds 30 and 50 are coupled together using a refractory sealing material and/or conventional refractory anchors (not shown).

Figure 5:
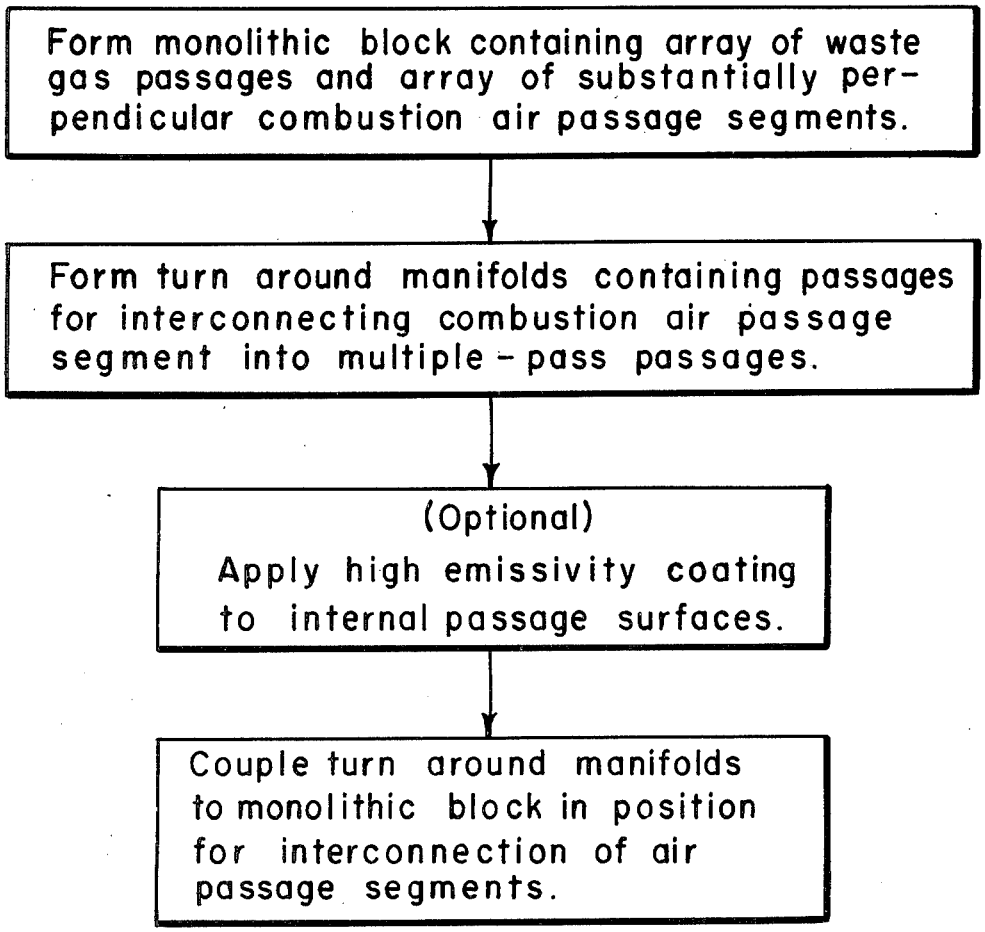
FIG. 5 is a flow diagram of the steps utilized in making a heat recuperator in accordance with the invention.

FIG. 5 is a flow diagram illustrating the steps of a preferred method of making a heat recuperator in accordance with the invention. As illustrated, the initial step involves forming at least one monolithic block containing a plurality of tapered, single-pass waste gas passages and, transversely thereto, a plurality of tapered segments for connection into a plurality of multiple-pass combustion air passages. Preferably, such a block is formed by casting or ramming refractory material in a mold.

A suitable mold for casting comprises a four sided rectangular parallelopiped with holes in one pair of opposing walls for mounting a set of conical tubes used to mold combustion air segments. The top and bottom of the parallelopiped are open. This mold is set bottom side down in a preformed groove on a refractory base and the conical tubes for molding the combustion air segments are fitted between the holes in the two opposing walls. Next, a set of conical tubes for molding the waste gas passages are centered into performed fittings in the refractory base so that they extend vertically upward from the refractory base to above the top of the mold. An open grid is then placed on the top of the mold to lock the vertical tubes in the proper position. As will be evident, the sides of the mold form the exterior walls of the refractory block and the interspaced tubes form the surfaces of the combustion air and waste gas passages. Advantageously, the sides of the mold, which can be steel or plastic, and the tubes, which can be metallic or synthetic plastic, are coated with a synthetic release material.

After assembly of the mold, material is prepared for casting or ramming. The preferred casting material is a castable alumino silicate refractory material such as the product marketed under the trade name "Plicast 36" by the Piblico Company, 1800 Kingsbury Street, Chicago, Illinois. The dry refractory powder is throughly mixed with sufficient water to form a castable mixture. Typically, the above-mentioned product is mixed with about 10 quarts of water per 100-pound sack of dry powder.

The castable refractory is then poured into the mold through the open grid as the mold is vibrated. As the material accumulates in the mold, it is advantageously "vibrated down" with vibratory "snakes" to produce a mix having a homogeneous density of approximately 1.95 kilograms per cubic meter. The mold can be filled to overflow and the excess material removed by skimming.

The refractory material is then permitted to set, demolded, dried and cured. After the castable has been poured, it should be immediately covered with a plastic sheet to prevent a too rapid loss of water by hydration and then be permitted to set for 24–36 hours. After the setting period, the "green block" can be demolded by removal of the tubes and wall sections. The demolded green block is relatively strong but should nonetheless be permitted to dry an additional 24 hours before moving.

After the drying period, the block can be moved into a furnace for curing. For the exemplary refractory, a suitable curing cycle is effected by heating up the block temperature in gradients as follows:

| Temperature (°C.) | Gradient (°C./Hr.) |
|---|---|
| 400° | 20°/Hr |
| 600° | 30°/Hr |
| 100° | 40°/Hr |
| 1360° (Peak) | 50°/Hr |

After the peak temperature is achieved, the furnace can be shut off. The cured block can be removed when the furnace temperature has dropped to about 300° C.

The next step, as illustrated in FIG. 5, involves forming the blocks of the turnaround manifolds with passages for interconnecting the linear segments of the combustion air passages. The blocks of the turnaround manifolds can conveniently be either cast or ram molded blocks of the same refractory material used in making the monolithic block 10, and the curing procedure is substantially the same.

The next step, which is optional but highly advantageous, involves applying to the internal surfaces of all passages a coating of high emissivity material. Such a coating increases the effective surface area or specific heat of these passages and thereby enhances heat transfer between the gases in the passages and the passage walls. A suitable material for this coating is a high emissivity cement marketed under the trade name "Super 3000" by C. E. Refractories, Inc.

The final step involves coupling together the monolithic block and the turnaround blocks in such a manner that the passages of the turnaround block interconnect the plurality of segments comprising each multiple-pass combustion air passage. Such coupling can be readily effected by use of conventional refractory anchors and cement to secure together the individual blocks of the turnaround manifolds and to bond surfaces 31 and 51 of the turnaround blocks with surfaces 22 and 23 of the monolithic block 10. A suitable cement for this application is marketed under the name "Refractory Mortar" by C. E. Refractories, Inc.

Alternatively, manifolds 30 and 50 can be ceramically bonded to surfaces 22 and 23 of block 10 during curing of block 10 and manifolds 30 and 50. With such a bond, the manifolds and block form an essentially monolithic structure. While a ceramic bond does form the manifolds and block into an essentially homogeneous mass, it has the disadvantage of making it impossible to remove the manifold for inspection and/or cleaning of the combustion gas passage segments.

There are many advantages of a heat recuperator of this structure over those previously known. Since the recuperator is formed in a single casting operation it can readily be made without skilled labor. Since it is a single monolithic structure, it is self supporting and can readily be installed in existing furnace and flue systems. At the same time, the monolithic structure eliminates the numerous joints between waste gas and combustion air passages which are a source of countless leaks in prior art recuperators. Because of the large mass and specific heat of the monolithic block, it serves as a "thermal flywheel" to maintain a relatively constant combustion air temperature despite fluctuations in waste gas temperature or flow.

While the invention has been described in connection with a preferred embodiment in which adjacent combustion air segments are tapered in opposite directions in the refractory block, it will be understood that the invention may be practiced by interconnecting other combinations of combustion air segments. In such cases, however, successive segments as connected should be tapered in opposite directions in the refractory block so that the multiple pass passage has a substantially continuous taper from a smaller area initial entry aperture to a larger area exit aperture. It likewise will be understood that the vertical and horizontal orientation of passages 12 and segments 15 and the numbers of such passages and segments are only illustrative. Indeed, my invention can be practiced using as few as one waste gas passage and two combustion air passage segments with only a single turnaround manifold. Advantageously, the turnaround manifolds are assembled from individual blocks such as blocks 32, 34, 36, 52 and 54 of FIGS. 1–3; but it is also possible to make each manifold in a monolithic structure. To increase the surface area of the passages it may be desired to shape them so that their cross-sections, are, for example, convoluted instead of circular as in the embodiment described in FIGS. 1–4. In addition, while the recuperator described above is a counter flow heat exchanger it will be recognized that the same principles are applicable to parallel flow heat exchangers.

It is also possible to practice my invention using a plurality of recuperators mounted in parallel and/or in series in the waste gas stream. In each case, however, joints between the waste gas passages and the combustion air passages are avoided by forming such passages in a monolithic block with suitable turnaround manifolds to connect together the combustion air segments to form the combustion air passage.

Thus, it is to be understood that these embodiments are merely illustrative of the many possible specific embodiments which can represent applications of the principles of the invention. Numerous and varied methods and products can be devised by those skilled in the art without departing from the spirit and scope of the present invention.

I claim:

1. A method for making a heat recuperator comprising the steps of:

forming a monolithic block containing a first array of waste gas passages therethrough and a second array of combustion air passage segments therethrough, said combustion air passage segments being oriented in a direction substantially perpendicular to said waste gas passages, the average diameter of some combustion air passage segments being greater than that of other combustion air passage segments;

forming at least one turnaround manifold containing at least one passage for interconnecting a pair of combustion air passage segments; and coupling said turnaround manifold to said monolithic block in such position as to interconnect a pair of combustion air passage segments having different average diameters, thereby forming at least one multiple-pass combustion air passage in which the average diameter of successive segments increases from one segment to the next.

2. The method of claim 1 wherein:

said monolithic block is formed containing a two dimensional array of straight-line waste gas passages and a two dimensional array of straight-line combustion air passage segments, said combustion air passage segments being oriented in a direction substantially perpendicular to said waste gas passages, and sufficient turnaround manifolds are coupled to said monolithic block to interconnect the combustion air passage segments so as to form a plurality of multiple-pass combustion air passages in said monolithic block.

3. The method of claim 1 wherein the step of coupling the manifold to the block comprises the step of forming a ceramic bond between the manifold and the block as the manifold and block are simultaneously cured.

4. The method of claim 1 wherein:

at least three groups of combustion air passage segments are formed in said monolithic block, a first group of combustion air passage segments having a first average diameter, a second group of combustion air passage segments having a second average diameter greater than said first average diameter, and a third group of combustion air passage segments having a third average diameter greater than said second average diameter;

at least two turnaround manifolds are formed; and the step of coupling the turnaround manifold to said monolithic block comprises the steps of:

coupling one turnaround manifold to said monolithic block in such position as to interconnect at least one combustion air passage segment of the first group with a combustion air passage segment of the second group; and coupling a second turnaround manifold to said monolithic block in said position as to interconnect at least one of the combustion air passage segments of the third group to at least one of the combustion air passage segments of the second group which is interconnected by the first manifold to a combustion air passage segment of the first group, thereby forming at least one multi-pass combustion air passage in which the average diameter of successive segments progressively increases.

5. The method of claim 1 wherein:

said monolithic block is formed by the casting of refractory ceramic material; and said waste gas passages and said combustion air passage segments are tapered.

6. The method of claim 5 wherein said waste gas passage and said combustion air passage segments are conical.

7. The method of claim 5 wherein:

said waste gas passages are tapered from a larger area entry aperture to a smaller area exit aperture; and combustion air passage segments are tapered in opposite directions in the monolithic block so that the interconnection of successive segments produces a multiple-pass combustion air passage with a substantially continuous overall taper from a smaller area entry aperture to a larger area exit aperture.

8. A method for making a heat recuperator comprising the steps of:

forming a monolithic block by casting a refractory ceramic material to form a first array of tapered waste gas passages and a second array of tapered combustion air passage segments, said combustion air passage segments being oriented in a direction substantially perpendicular to said waste gas passages, at least three groups of combustion air passage segments being formed in said monolithic block, a first group of combustion air passage segments having a first average diameter, a second group of combustion air passage segments having a second average diameter greater than said first average diameter, and a third group of combustion air passage segments having a third average diameter greater than said second average diameter;

forming at least two turnaround manifold containing a plurality of passages for interconnecting pairs of combustion air passage segments, each such passage interconnecting only one pair of combustion air passage segments; and coupling one turnaround manifold to said monolithic lithic block in such position as to interconnect a plurality of combustion air passage segments of the first group with a plurality of combustion air passage segments of the second group; and coupling a second turnaround manifold to said monolithic block in such position as to interconnect a plurality of the combustion air passage segments of the third group to a plurality of the combustion air passage segments of the second group which are interconnected by the first manifold to combustion air passage segments of the first group, thereby forming a plurality of multi-pass combustion air passages in which the average diameter of successive segments progressively increases.

9. A method for making a heat recuperator comprising the steps of:

forming a monolithic block by casting a refractory ceramic material to form a first array of tapered waste gas passages and a second array of tapered combustion air passage segments, said combustion air passage segments being oriented in a direction substantially perpendicular to said waste gas passages;

said waste gas passages being tapered from a larger area entry aperture to a smaller area exit aperture;

said air combustion passage segments are tapered in opposite directions in the monolithic block;

forming at least one turnaround manifold containing a plurality of passages for interconnecting pairs of combustion air passage segments, each such passage interconnecting only one pair of combustion air passage segments; and coupling said turnaround manifold to said monolithic block in such position as to interconnect a pair of combustion air passage segments, thereby forming at least one multiple-pass combustion air passage in which successive segments produce a multiple-pass combustion air passage with a substantially continuous overall taper from a smaller area entry aperture to a larger area exit aperture.

* * * * *